US007277003B2

(12) United States Patent
Inoue et al.

(10) Patent No.: US 7,277,003 B2
(45) Date of Patent: Oct. 2, 2007

(54) ELECTROSTATIC DISCHARGE PROTECTION COMPONENT

(75) Inventors: Tatsuya Inoue, Osaka (JP); Hidenori Katsumura, Hyogo (JP); Hiroshi Kagata, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 363 days.

(21) Appl. No.: 11/117,393

(22) Filed: Apr. 29, 2005

(65) Prior Publication Data

US 2005/0195549 A1 Sep. 8, 2005

(51) Int. Cl.
*H01C 7/10* (2006.01)
*H01C 7/13* (2006.01)

(52) U.S. Cl. ..... 338/20; 338/21; 361/119

(58) Field of Classification Search ..... 338/20–21; 361/118–120

See application file for complete search history.

(56) References Cited

U.S. PATENT DOCUMENTS 5,208,727 A * 5/1993 Okamoto et al. ..... 361/321.4
6,147,588 A * 11/2000 Nakayama et al. ..... 338/21
6,608,547 B1 * 8/2003 Greier et al. ..... 338/21
6,721,157 B2 * 4/2004 Shin ..... 361/120
7,075,404 B2 * 7/2006 Hirose et al. ..... 338/21

FOREIGN PATENT DOCUMENTS

JP 08-031616 2/1996

* cited by examiner

*Primary Examiner*—K. Richard Lee
(74) *Attorney, Agent, or Firm*—McDermott Will & Emery LLP

(57) ABSTRACT

An electrostatic discharge protection component of an array type includes ceramic insulating substrate 12; varistor region 10 which is pasted on ceramic insulating substrate 12 and then is sintered integrally with ceramic insulating substrate 12; and at least one ground outer electrode 15A and a plurality of input/output outer electrodes 15B. Varistor region 10 includes at least one ground inner electrode 14A, varistor layer 10C and the plurality of input/output outer electrodes 15B so as to form the plurality of varistors. Ground inner electrode 14A is connected with ground outer electrode 15A. This structure enables the protection component to be extremely thin.

7 Claims, 5 Drawing Sheets

ELECTROSTATIC DISCHARGE PROTECTION COMPONENT

BACKGROUND OF THE INVENTION

1. Field of the Invention

The present invention relates to an electrostatic discharge protection component (hereinafter referred to simply as protection component) which protects an electronic device from electrostatic discharge.

2. Background Art

In recent years, electronic devices such as mobile phones are rapidly reducing in size and increasing in function. Along with this trend, their circuits are becoming denser, and on the other hand, are having lower and lower withstand voltages. As a result, when a person happens to come into contact with a circuit terminal of an electronic device, an electrostatic discharge pulse that is caused by the contact more and more tends to damage an electric circuit in the device, thereby causing an increasing number of defects.

A conventional countermeasure against such electrostatic discharge pulses is to provide a multilayer chip varistor between the incoming line of electrostatic discharge and the ground so as to bypass the electrostatic discharge, thereby reducing the voltage applied to the circuit of the electronic device.

An example of conventional multilayer chip varistors to suppress electrostatic discharge is disclosed in Japanese Patent Unexamined Publication No.H08-31616.

However, as they are becoming smaller and more functional, electronic devices have an increasing number of parts to be protected against electrostatic discharge pulses. On the other hand, there is a growing demand for protection components of an array type having a plurality of components, as well as of a single component type. Also, in order to achieve smaller and thinner electronic devices, protection components are expected to be thinner.

It is difficult, however, to thin the conventional multilayer chip varistors because they must have a specific thickness in order to keep the physical strength of their material. For example, a commercially available multilayer chip varistor with a width of 1.25 mm and a length of 2.0 mm or so must have a thickness of not less than 0.5 mm. If it is desired to further reduce the thickness, the varistor is required to be further decreased in size. This makes it very difficult to integrate a number of components into an array. Thus, in the case of a multilayer chip varistor, its thickness and the number of components in the array have a trade-off relation with each other.

The cause of the trade-off relation is the low flexural strength of a zinc oxide-based material contained in the multilayer chip varistor. More specifically, using this material for a chip component makes the flexural strength as low as 100 MPa or lower. This low flexural strength makes it difficult to avoid the trade-off relation in the conventional multilayer chip varistors.

The present invention has an object of providing a protection component of an array type which has a low-profile, a large mechanical strength and excellent practicality.

SUMMARY OF THE INVENTION

In order to achieve the aforementioned object, the protection component of the present invention is an array type having a plurality of varistors, and comprises:

a ceramic insulating substrate;

a varistor region which is pasted on the ceramic insulating substrate and then is sintered integrally with the ceramic insulating substrate; and a ground outer electrode and a plurality of input/output outer electrodes, wherein the varistor region includes a ground inner electrode, a varistor layer and the plurality of input/output outer electrodes so as to form the plurality of varistors, and the ground inner electrode is connected with the ground outer electrode.

With this structure, a plurality of very thin varistors can be formed onto a ceramic insulating substrate with a large mechanical strength. This results in a protection component of an array type having a low-profile, a large mechanical strength and a number of varistors.

In the structure, the varistor region may further include a plurality of inner electrodes in a position to oppose the ground inner electrode via the varistor layer, and the plurality of inner electrodes may be connected with the corresponding ones of the plurality of input/output outer electrodes. This results in a protection component of an array type having a number of parallel-connected independent varistors, thereby facilitating the setting of a specific capacitance.

In the structure, the ground outer electrode and the plurality of input/output outer electrodes may be formed on the same surface of the varistor region. Since the outer electrodes to be connected with the circuit substrate are thus disposed on the same surface, they can keep the circuit substrate thin when mounted thereon. This enables the circuit to be smaller, denser and thinner, and also can reduce the mounting cost.

In the structure, it is preferable that the ceramic insulating substrate be at least twice as thick as the varistor region. This structure can eliminate defects caused by warpage when the varistor region and the ceramic insulating substrate are integrally sintered, thereby greatly improving the production yield.

In the structure, the varistor layer may be made of a varistor material mainly composed of zinc oxide, and the ceramic insulating substrate may be an alumina substrate with a copper oxide content of not more than 0.1% by weight. The reduced content of copper oxide, which is a material to inhibit the property manifestation of the zinc oxide varistor, can prevent the diffusion of the copper oxide from the alumina substrate to the zinc oxide varistor material when sintered. Consequently, it is secured to manifest the varistor properties with good reproducibility. This results in a protection component having more stable properties and a good yield.

In the structure, the varistor region may be provided, on a top surface thereof, with a protective film except for a region where the ground outer electrode and the plurality of input/output outer electrodes are formed. This facilitates the application of plating to the outer electrodes, thereby obtaining a protection component with excellent mountability.

In the structure, as the ceramic insulating substrate, a substrate including a plurality of inductors may be used, and the plurality of inductors may be electrically connected in series with the corresponding ones of the plurality of varistors. This structure can provide a protection component with not only varistor function but also inductor function. As a result, the effect of reducing electrostatic discharge can be further improved by, for example, adding filter function.

As described hereinbefore, the present invention is a protection component of an array type having a plurality of varistors in the varistor region, with the features of low profile and large mechanical strength. As a result, this protection component is useful as a component to protect a small and thin electronic device such as a mobile phone from being damaged by electrostatic discharge pulses.

DETAILED DESCRIPTION OF THE INVENTION

A protection component according to the present invention will be described in detail as follows with reference to accompanying drawings. Note that the same elements will be referred to with the same reference marks, and may be described only once.

First Embodiment

Figure 1:
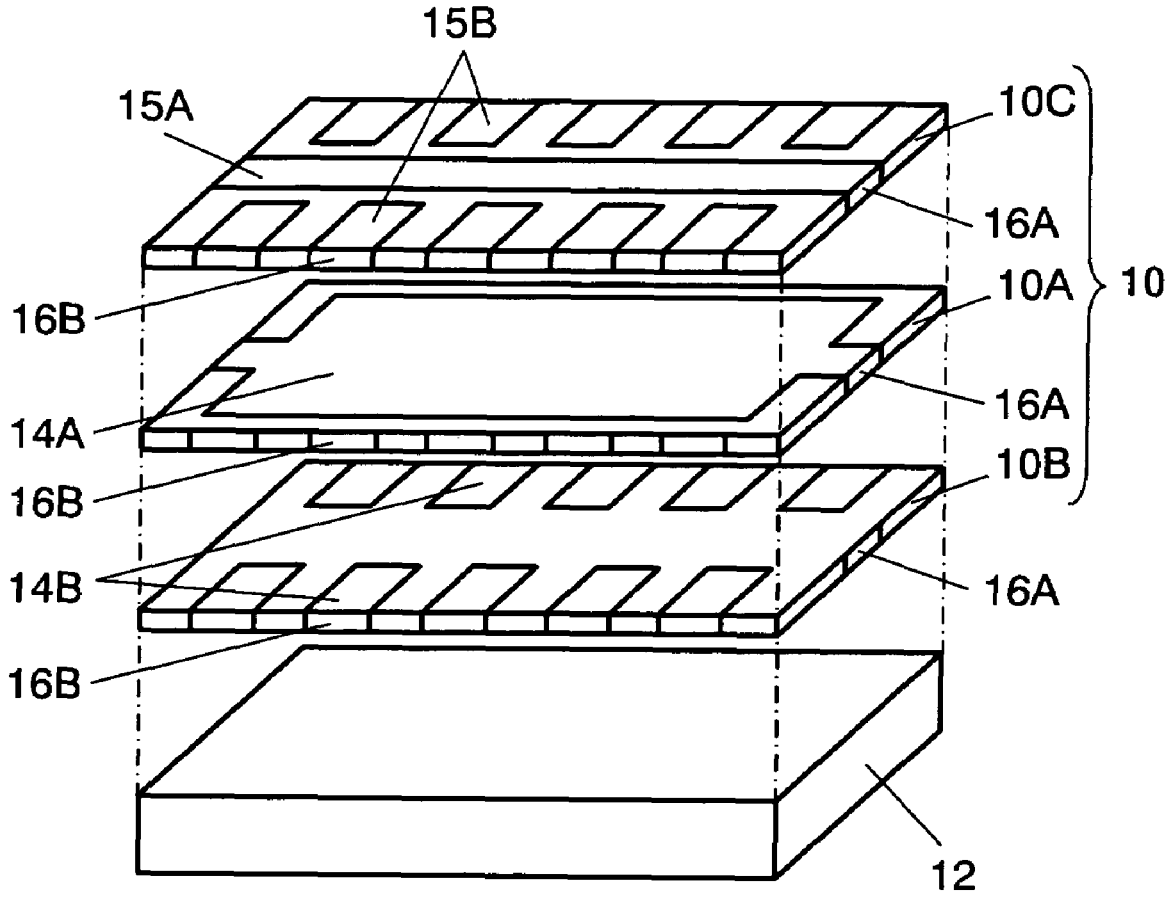
FIG. 1 is a schematic exploded perspective view of a protection component according to a first embodiment of the present invention.
Figure 2:
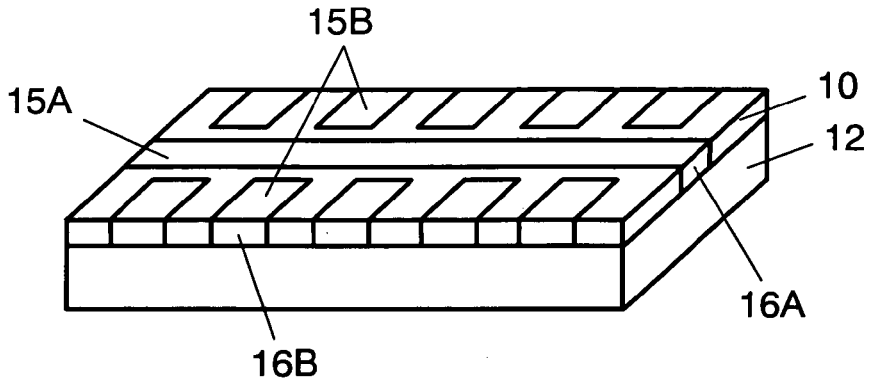
FIG. 2 is an external perspective view of the protection component according to the first embodiment of the present invention.
Figure 3:
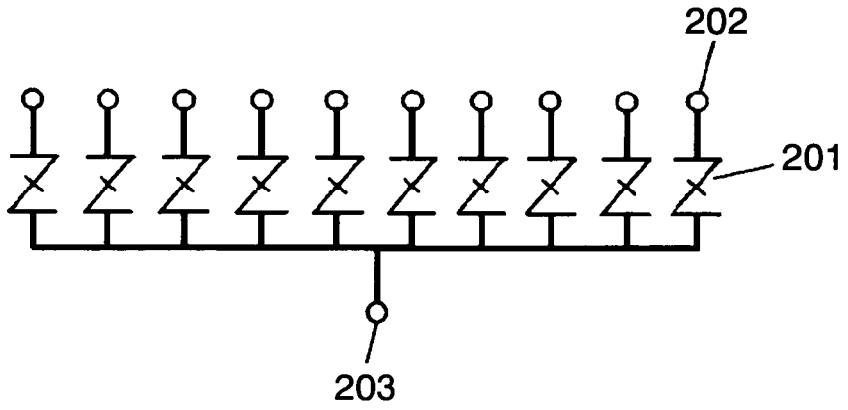
FIG. 3 is an equivalent circuit diagram of the protection component according to the first embodiment of the present invention.

FIG. 1 is a schematic exploded perspective view of a protection component according to a first embodiment of the present invention. FIG. 2 is an external perspective view of the protection component. FIG. 3 is an equivalent circuit diagram of the protection component.

As shown in FIGS. 1 and 2, the protection component of the present embodiment comprises an integrally sintered combination of varistor region 10 containing a plurality of varistors and ceramic insulating substrate 12. Varistor region 10 is a laminate of varistor layers 10A, 10B and 10C; ground inner electrode 14A and inner electrodes 14B; and ground outer electrode 15A and input/output outer electrodes 15B.

Varistor region 10, which is in the form of green sheets provided with conductor layers thereon as will be described later, is pasted onto ceramic insulating substrate 12 and integrally sintered so as form a ceramic sintered body. The ceramic sintered body is then cut to form connection electrodes. More specifically, in varistor region 10, ground inner electrode 14A is drawn out to both ends of the short side of the ceramic sintered body as shown in FIG. 1, and is electrically connected with ground outer electrode 15A via connection electrodes 16A. On the other hand, inner electrodes 14B are drawn out to both ends of the long side of the ceramic sintered body, and are electrically connected with the corresponding ones of input/output outer electrodes 15B via connection electrodes 16B.

As described hereinbefore, the protection component of the present embodiment is an integrated combination of ceramic insulating substrate 12 and varistor region 10, which are integrally sintered to form a ceramic sintered body. In the present embodiment, ten inner electrodes 14B, ten input/output outer electrodes 15B and one ground inner electrode 14A are arranged to sandwich varistor layers 10A and 10C therebetween. As a result, ten independent varistors are formed. The terminals at one end of these varistors are electrically connected in parallel with ground outer electrode 15A, and the terminals at the other end are connected with the corresponding ones of input/output outer electrodes 15B. Thus, the protection component forms a varistor array composed of ten independent varistors.

FIG. 3 is an equivalent circuit diagram of the protection component of the present embodiment. In FIG. 3, varistors 201 are connected with input/output outer electrodes 202 and ground outer electrode 203. Varistors 201 shown in FIG. 3 correspond to the varistors described with FIG. 1. Input/output outer electrodes 202 correspond to input/output outer electrodes 15B, and ground outer electrode 203 corresponds to ground outer electrode 15A shown in FIG. 1.

As described above, the protection component of the present embodiment is a ceramic sintered body formed by sintering varistor region 10, which includes varistor layers 10A, 10B and 10C; ground inner electrode 14A and inner electrodes 14B; ground outer electrode 15A and input/output outer electrodes 15B; and connection electrodes 16A and 16B, integrally onto ceramic insulating substrate 12. Thus forming the varistors onto the ceramic insulating substrate having a large mechanical strength can provide a protection component with a low profile, a large mechanical strength and excellent practicality.

Furthermore, input/output outer electrodes 15B and ground inner electrode 14A are arranged to sandwich varistor layer 10C therebetween, and inner electrodes 14B and ground inner electrode 14A are arranged to sandwich varistor layer 10A therebetween, so that the varistors are connected in parallel with each other. In addition, these parallel-connected varistors are independent of each other. The terminals at one end of these varistors are electrically connected in parallel with ground outer electrode 15A, and the terminals at the other end are connected with the corresponding ones of input/output outer electrodes 15B. This structure can provide a protection component of an array type having a number of independent varistors. Even if the protection component is greatly reduced in thickness, it is still possible to prevent the occurrence of defects in the manufacturing or mounting process.

The ceramic sintered body has ground outer electrode 15A and input/output outer electrodes 15B on the same surface thereof. These outer electrodes are to be connected with the circuit substrate, and are thin enough to minimize an increase in the thickness of the circuit when they are mounted on the circuit substrate. This allows the circuit to be smaller, denser and thinner. Furthermore, being an array type can reduce the mounting cost.

A method for manufacturing the protection component of the present embodiment will be described as follows with reference to FIGS. 1 and 2.

First, zinc oxide green sheets are produced using ceramic powder having zinc oxide (ZnO) as a main component and also using an organic binder. At this moment, each zinc oxide green sheet has a thickness of about 30 μm.

A plurality of conductor layers, which turn to inner electrodes 14B, are formed onto a zinc oxide green sheet (which turns to varistor layer 10B after being sintered) by using a conductive paste mainly composed of silver by screen printing. Then, another zinc oxide green sheet (which turns to varistor layer 10A after being sintered) is laminated onto these conductor layers.

Then, a single conductor layer which turns to ground inner electrode 14A is formed onto the laminated zinc oxide green sheet by using the conductive paste by screen printing. Further another zinc oxide green sheet (which turns to varistor layer 10C after being sintered) is laminated on the single conductor layer. Then, conductor layers, which turn to input/output outer electrodes 15B and ground outer electrode 15A, are formed on the zinc oxide green sheet by using the conductive paste by screen printing. This is the completion of a laminate which turns to varistor region 10.

Next, the aforementioned laminate is pasted on an alumina substrate which is used as ceramic insulating substrate 12 so as to form a laminate block.

The alumina substrate is about 250 μm thick, and each of the conductor layers is about 2.5 μm thick. The laminate block consists of a plurality of units each having the shape shown in FIGS. 1 and 2 so that the printed conductor layers can be arranged on the zinc oxide green sheets in the pattern shown in FIGS. 1 and 2 after the laminate block is cut.

Next, the laminate block is heated in the atmosphere for a removing the binder. Then, the laminate block is heated and sintered at 930° C. in the atmosphere to form an integrally sintered body. Later, the sintered body can be cut in desired dimensions, thereby obtaining a ceramic sintered body which has not yet been provided with connection electrodes 16A and 16B of the protection component shown in FIGS. 1 and 2.

Next, the conductive paste mainly composed of silver is applied onto both ends of the short side of the ceramic sintered body to which ground inner electrode 14A has been exposed so that the exposed ends of ground inner electrode 14A can be electrically connected with ground outer electrode 15A. In the same manner, the conductive paste mainly composed of silver is applied onto both ends of the long side of the ceramic sintered body to which inner electrodes 14B have been exposed so that the exposed ends of inner electrodes 14B can be electrically connected with the corresponding ones of input/output outer electrodes 15B. After these applications, sintering is performed at 800° C. to form connection electrodes 16A and 16B. This is the completion of protection component of the present embodiment shown in FIGS. 1 and 2.

The protection component of the present embodiment thus manufactured measures about 6.0 mm in length, about 3.0 mm in width and about 0.3 mm in thickness. Each of the ten independent varistors has a capacitance of 17 to 23 pF between input/output outer electrodes 15B and ground outer electrode 15A, and a varistor voltage $V_{1mA}$, which is the voltage at a current of 1 mA, of 25 to 30V.

Figure 4:
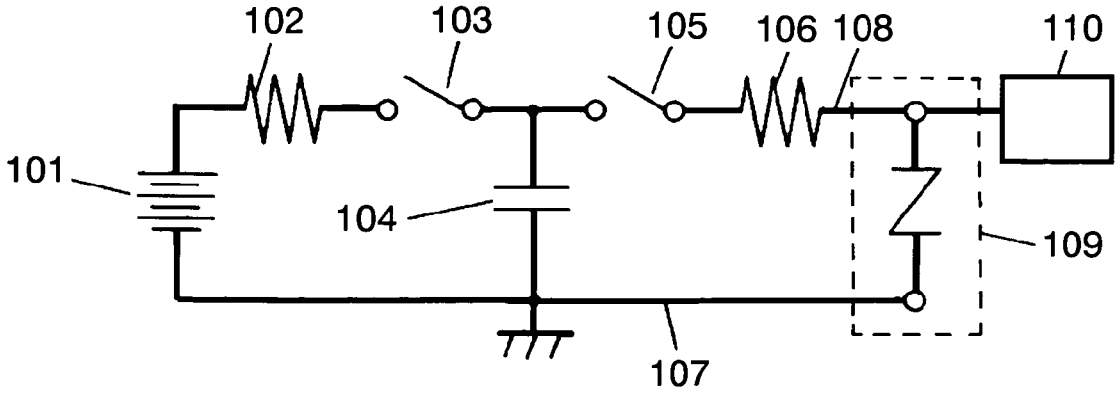
FIG. 4 is a circuit diagram of electrostatic discharge tests of the protection component according to the first embodiment of the present invention.

The following is a description of the evaluation results of the electrostatic discharge tests applied to the protection component of the present embodiment. The electrostatic discharge tests are performed by using the circuit shown in FIG. 4. FIG. 4 shows a circuit block diagram for electrostatic discharge tests. The electrostatic discharge tests are performed as follows. First, switch 103 is connected so that a specific voltage is applied from DC power supply 101 so as to store electric charge in capacitance box 104 having a capacitance of 150 pF via resistor 102. Later, switching takes place in such a manner that switch 103 is released and switch 105 is connected. This enables the electric charge stored in capacitance box 104 to be applied as an electrostatic discharge pulse onto a protected appliance 110 through signal line 108 via resistor 106.

Then, the protection component of the present embodiment is used as evaluation sample 109 shown in FIG. 4. In this case, input/output outer electrode 202 of one of the ten varistors is connected with the signal line 108 side, and ground outer electrode 203 is connected with ground line 107. And input/output outer electrode 202 corresponds to one of input/output outer electrodes 15B, and ground outer electrode 203 corresponds to ground outer electrode 15A shown in FIG. 2.

A measurement is performed to determine the voltage waveform between a point on the signal line 108 that is immediately before protected appliance 110 and ground line 107 under the application of the electrostatic discharge pulse. This measurement evaluates the effect of bypassing the electrostatic discharge pulse on the reduction of the voltage to be applied on protected appliance 110, that is, the effect of evaluation sample 109 or the protection component absorbing electrostatic discharge pulses on the reduction of the voltage to be applied on protected appliance 110. The evaluation is given to each of the ten varistors.

For a comparison, a conventional multilayer varistor at a capacitance of 3 pF and a varistor voltage $V_{1mA}$ of 27V is evaluated by being connected between signal line 108 and ground line 107.

The conventional multilayer varistor and the protection component of the present embodiment are respectively evaluated for the effect of reducing electrostatic discharge pulse voltage by applying an electrostatic discharge pulse with a voltage of 8 kV from the circuit shown in FIG. 4 and by measuring the peak voltage value of the electrostatic discharge pulse applied on protected appliance 110.

When the conventional multilayer varistor as the comparative example is connected between signal line 108 and ground line 107, the peak voltage value applied on protected appliance 110 is about 220V. In contrast, when the protection component of the present embodiment is connected, the peak voltage values applied on protected appliance 110 are about 180 to 240V at the respective terminals. This reveals that the protection component of the present embodiment has an enough effect of reducing electrostatic discharge pulses. More specifically, it turns out that in spite of the completely different structure as the protection component, its effect of reducing electrostatic discharge pulses is almost the same as that of the conventional multilayer varistor.

For another comparison, a multilayer varistor having the same shape as that of the protection component of the present embodiment is produced by the same process as in the conventional multilayer varistor by exclusively using the zinc oxide material without providing an alumina substrate. This multilayer varistor measures about 6.0 mm in length, about 3.0 mm in width and about 0.3 mm in thickness. However, in this case, the zinc oxide ceramic has so low a sintered strength that the multilayer varistor is too thin with respect to its size in the area's direction, thereby having poor mechanical strength. This disadvantageous feature facilitates cuts or breakage at the time of forming the outer electrodes or measuring electrical properties, making it impossible to manufacture a multilayer varistor with a good yield.

Also, it is tried to increase the sintered thickness of varistor region 10 of the protection component of the present embodiment by increasing the number of layers in varistor region 10. More specifically, the thickness of varistor region 10 is set larger than ½ of 250 μm which is the thickness of alumina substrate 12, namely, set to about 130 μm or larger. This results in large warpage after the sintering. Thus, no practicable protection component is obtained. Therefore, the ceramic insulating substrate is preferably at least two times as thick as the varistor region.

In a case where an alumina substrate containing 0.1% or more of copper oxide is used as the ceramic insulating substrate in the protection component of the present embodiment, an electrostatic discharge pulse of 8 kV applied from the electrostatic discharge test circuit shown in FIG. 4 has a peak voltage value of about 400V. This result reveals that the effect of absorbing and reducing electrostatic discharge pulses is deteriorated by the use of this type of alumina substrate. Consequently, the ceramic insulating substrate is preferably an alumina substrate with a copper oxide content of not more than 0.1% by weight.

Second Embodiment

Figure 5:
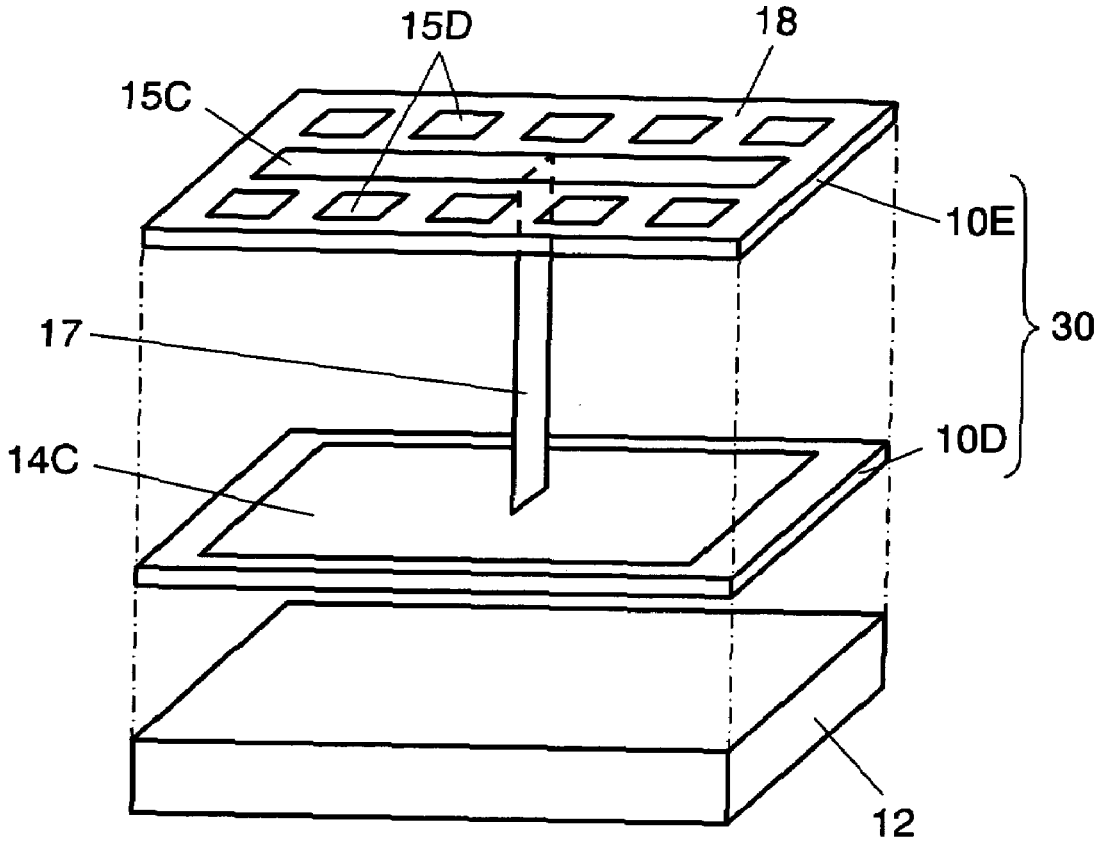
FIG. 5 is a schematic exploded perspective view of a protection component according to a second embodiment of the present invention.
Figure 6:
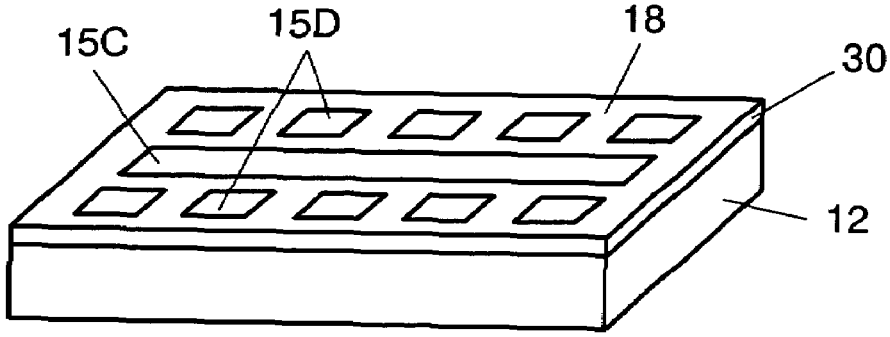
FIG. 6 is an external perspective view of the protection component according to the second embodiment of the present invention.

FIG. 5 is a schematic exploded perspective view of a protection component according to a second embodiment of the present invention. FIG. 6 is an external perspective view of the protection component. The equivalent circuit diagram of the protection component of the present embodiment is identical to that described in the first embodiment with FIG. 3.

As shown in FIGS. 5 and 6, the protection component of the present embodiment, as that of the first embodiment, comprises a ceramic sintered body formed by integrally sintering varistor region 30 and ceramic insulating substrate 12. Varistor region 30 is a laminate of varistor layers 10D, 10E; ground inner electrode 14C; ground outer electrode 15C; and input/output outer electrodes 15D. Ground inner electrode 14C is electrically connected with ground outer electrode 15C by via conductor 17. On the top surface of varistor region 30, protective film 18 is provided except for the region on which ground outer electrode 15C and input/output outer electrodes 15D are formed.

In the protection component of the present embodiment, ten input/output outer electrodes 15D and one ground inner electrode 14C are arranged to sandwich varistor layer 10E therebetween, thereby forming ten independent varistors. The terminals at one end of these varistors are electrically connected in parallel with ground outer electrode 15C, and the terminals at the other end are connected with the corresponding ones of input/output outer electrodes 15D. The equivalent circuit of the protection component of the present embodiment is identical to that shown in FIG. 3.

Similar to that of the first embodiment, the protection component of the present embodiment forms the varistors on ceramic insulating substrate 12 having a large mechanical strength. This structure can provide a protection component with a low profile, a large mechanical strength and excellent practicality. Input/output outer electrodes 15D formed on the surface of the ceramic sintered body and ground inner electrode 14C form the independent varistors in such a manner as to sandwich varistor layer 10E therebetween. This arrangement enables a protection component of an array type having a number of independent varistors to be extremely thin.

Ground outer electrode 15C and input/output outer electrodes 15D to be connected with the circuit substrate are disposed on the same surface to minimize an increase in the thickness of the circuit when they are mounted on the circuit substrate. This makes the circuit smaller, denser and thinner. Furthermore, being an array type can reduce the mounting cost.

In the protection component of the present embodiment, ground inner electrode 14C is electrically connected with ground outer electrode 15C by via conductor 17. This can eliminate the process of forming connection electrodes at ends of ground inner electrode 14C.

The top surface of varistor region 30 is covered with protective film 18 except for the region on which ground outer electrode 15C and input/output outer electrodes 15D are formed. This facilitates to coat ground outer electrode 15C and input/output outer electrodes 15D with plating. As a result, a protection component with more excellent mountability can be obtained.

A method for manufacturing the protection component of the present embodiment will be described as follows with reference to FIGS. 5 and 6.

First, zinc oxide green sheets are produced using ceramic powder having zinc oxide (ZnO) as a main component and also using an organic binder. At this moment, each of the zinc oxide green sheets has a thickness of about 30 μm.

A conductor layer, which turns to ground inner electrode 14C, is formed onto a zinc oxide green sheet (which turns to varistor layer 10D after being sintered) by using the aforementioned conductive paste mainly composed of silver by screen printing. Then, another zinc oxide green sheet (which turns to varistor layer 10E after being sintered) is laminated on the conductor layer. The zinc oxide green sheet is filled with the conductive paste, which turns to be via conductor 17, in a region that allows the zinc oxide green sheet to be electrically connected with ground outer electrode 15C. Furthermore, conductor layers, which turn to be ground outer electrode 15C and input/output outer electrodes 15D, are formed on the zinc oxide green sheet by using the conductive paste by screen printing. This is the completion of a laminate which turns to varistor region 30.

Next, the laminate is pasted on an alumina substrate which is used as ceramic insulating substrate 12 so as to form a laminate block. The alumina substrate is about 250 μm thick, and each of the conductor layers is about 2.5 μm. The laminate block consists of a plurality of units each having the shape shown in FIGS. 5 and 6 so that the printed conductor layers can be arranged on the green sheets in the pattern shown in FIGS. 5 and 6 after the laminate block is cut.

Next, the laminate block is heated in the atmosphere for removing the binder. Then, the laminate block is sintered by being heated to 930° C. in the atmosphere to form an integrally sintered body. Later, the top surface of varistor region 30 is coated by screen printing using a thermosetting resin paste except for the region where ground outer electrode 15C and input/output outer electrodes 15D are formed. The thermosetting resin paste is hardened at a desired temperature to form protective film 18.

After the formation of protective film 18, the surface of the sintered body provided with ground outer electrode 15C and outer electrodes 15D is plated with nickel (Ni) and solder. Then, the sintered body is cut in desired dimensions. This is the completion of the protection component of the present embodiment shown in FIGS. 5 and 6.

The protection component of the present embodiment measures about 6.0 mm in length, about 3.0 mm in width and about 0.3 mm in thickness. Each of the ten independent varistors has a capacitance of 6 to 8 pF between input/output outer electrodes 15D and ground outer electrode 15C, and a varistor voltage $V_{1mA}$ of 25 to 30V.

The following is a description of the evaluation of the protection component of the present embodiment for the effect of reducing electrostatic discharge pulses. The evaluation is performed in the same manner as in the electrostatic discharge tests described in the first embodiment. More specifically, the protection component of the present embodiment is used as evaluation sample 109 shown in FIG. 4. Input/output outer electrode 202 of one of the varistors is connected to the signal line 108 side, whereas ground outer electrode 203 is connected with ground line 107. Then, the protection component is evaluated for the effect of reducing electrostatic discharge pulse voltage by applying an electrostatic discharge pulse with a voltage of 8 kV from the circuit shown in FIG. 4 and by measuring the peak voltage value of the electrostatic discharge pulse applied on protected appliance 110. The evaluation is given to each of the ten varistors. In the varistors, input/output outer electrodes 202 correspond to input/output outer electrodes 15D, and ground outer electrode 203 corresponds to ground outer electrode 15C shown in FIG. 5.

When the protection component of the present embodiment is provided, the peak voltage values applied on protected appliance 110 are about 200 to 260V at the respective terminals. This reveals that the protection component of the present embodiment has the effect of absorbing and reducing electrostatic discharge pulses sufficiently.

In the method for manufacturing the protection component of the present embodiment, it turns out that when nickel (Ni) and solder are plated in the absence of protective film 18, there is a phenomenon in which varistor layer 10E is plated in regions other than where ground outer electrode 15C and input/output outer electrodes 15D are formed, thereby extremely decreasing the yield.

Although protective film 18 is made of resin paste in the protection component of the present embodiment, it may be formed by sintering glass paste.

Third Embodiment

Figure 7:
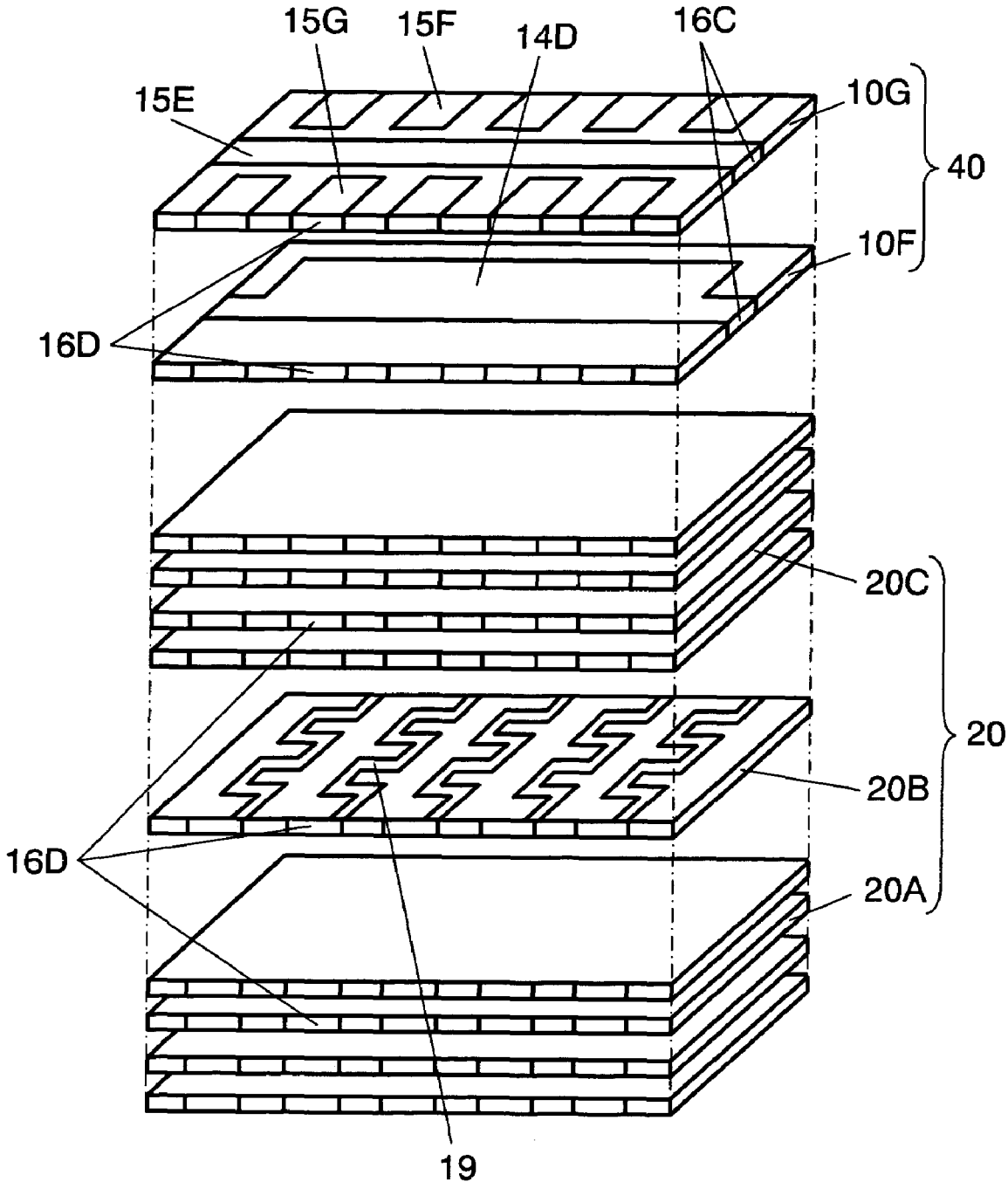
FIG. 7 is a schematic exploded perspective view of a protection component according to a third embodiment of the present invention.
Figure 8:
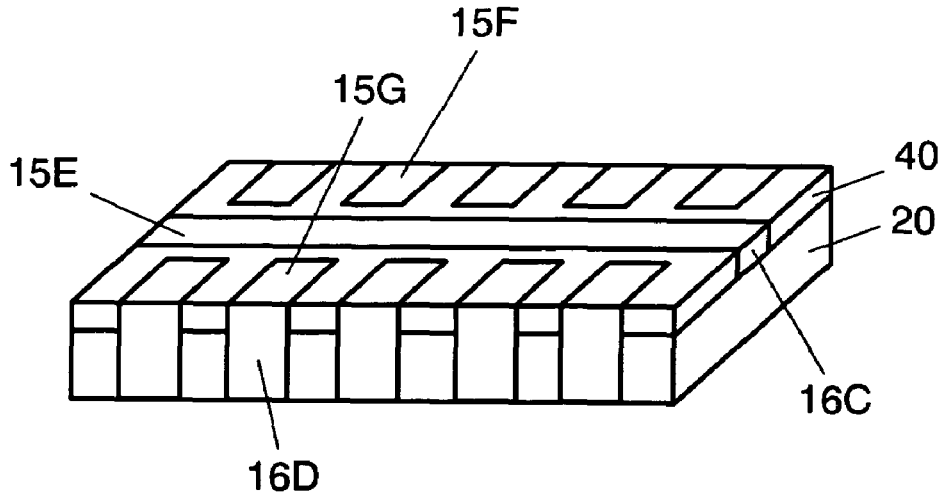
FIG. 8 is an external perspective view of the protection component according to the third embodiment of the present invention.
Figure 9:
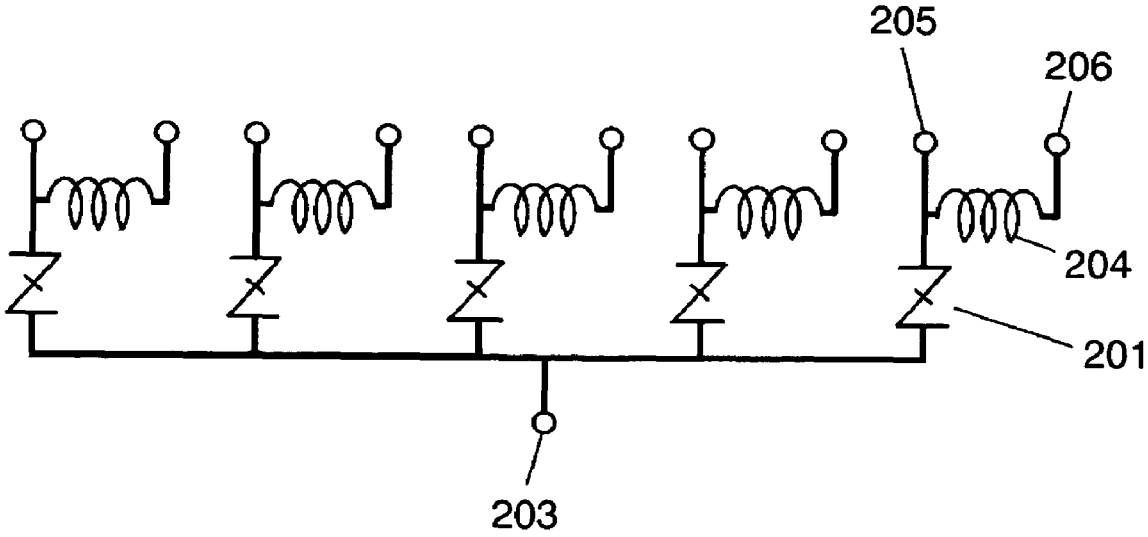
FIG. 9 is an equivalent circuit diagram of the protection component according to the third embodiment of the present invention.

FIG. 7 is a schematic exploded perspective view of a protection component according to a third embodiment of the present invention. FIG. 8 is an external perspective view of the protection component. FIG. 9 is an equivalent circuit diagram of the protection component.

As shown in FIGS. 7 and 8, the protection component of the present embodiment comprises an integrally sintered combination of varistor region 40 and low temperature co-fired ceramic substrate 20 containing inductors. In the present embodiment, as the ceramic insulating substrate, low temperature co-fired ceramic substrate 20 is used.

Varistor region 40 is a laminate of varistor layers 10F and 10G; ground inner electrode 14D; ground outer electrode 15E; input outer electrodes 15F; and output outer electrodes 15G. On the other hand, low temperature co-fired ceramic substrate 20 is a laminate of ceramic layers mainly composed of glass and ceramic powder (hereinafter referred to simply as glass-ceramic leyer) 20A, 20B and 20C, and inductor conductors 19, thereby containing inductors.

As described above, the ceramic sintered body formed by integrally sintering varistor region 40 and low temperature co-fired ceramic substrate 20 containing the inductors is provided with ground outer electrode 15E, input outer electrodes 15F and output outer electrodes 15G on the same surface thereof. Ground inner electrode 14D is drawn out to both ends of the short side of the ceramic sintered body, and is electrically connected with ground outer electrode 15E via connection electrodes 16C. Both ends of inductor conductors 19 are drawn out to both ends of the long side of the ceramic sintered body so as to be electrically connected with input outer electrodes 15F at one side via connection electrodes (not illustrated), and with output outer electrodes 15G at the other side via connection electrodes 16D.

As described hereinbefore, the protection component of the present embodiment is characterized by using, as the ceramic insulating substrate, low temperature co-fired ceramic substrate 20 containing inductors, and by integrating low temperature co-fired ceramic substrate 20 with varistor region 40 to form a ceramic sintered body. In the present embodiment, five input outer electrodes 15F and one ground inner electrode 14D are arranged to sandwich varistor layer 10G therebetween, thereby forming five independent varistors. The terminals at one end of these varistors are electrically connected in parallel with one ground outer electrode 15E, and the terminals at the other end are connected with the corresponding ones of five input outer electrodes 15F. In addition, the five inductors are independent of each other by being electrically connected in series with the five varistors, and also being corrected with the corresponding ones of five output outer electrodes 15G.

In the case of the protection component of the present embodiment, the equivalent circuit is as shown in FIG. 9. In FIG. 9, varistors 201 are connected with ground outer electrode 203 and input outer electrodes 205, whereas inductors 204 are connected with inputouter electrodes 205 and output outer electrodes 206. Input outer electrodes 205 correspond to input outer electrodes 15F; output outer electrodes 206 correspond to output outer electrodes 15G; and ground outer electrode 203 corresponds to ground outer electrode 15E shown in FIGS. 7 and 8.

As described hereinbefore, similar to those of the first and second embodiments, the protection component of the present embodiment is provided with varistors on a ceramic insulating substrate with a large mechanical strength. This structure can provide a protection component with a low profile, a large mechanical strength and excellent practicality.

Input outer electrodes 15F formed on the surface of the ceramic sintered body and ground inner electrode 14D are arranged to sandwich varistor layer 10G therebetween, thereby forming the independent varistors. This arrangement enables the protection component of an array type having a number of independent varistors to be extremely thin. Ground outer electrode 15E, input outer electrodes 15F and output outer electrodes 15G to be connected with the circuit substrate are disposed on the same surface so as to minimize an increase in the thickness of the circuit when they are mounted on the circuit substrate. This can make the circuit smaller, denser and thinner. Furthermore, being an array type can reduce the mounting cost.

As the ceramic insulating substrate, low temperature co-fired ceramic substrate 20 containing a plurality of inductors is used. These inductors are electrically connected in series with the corresponding ones of the varistors, and are also connected with the corresponding ones of output outer electrodes 15G. This adds filter function so as to further improve the effect of reducing electrostatic discharge.

A method for manufacturing the protection component of the present embodiment will be described as follows with reference to FIGS. 7 and 8.

First, glass-ceramic green sheets are produced using glass and ceramic powder mainly containing borosilicate glass and alumina and also using an organic binder. At this moment, each of the glass-ceramic green sheets has a thickness of about 30 μm.

Next, several glass-ceramic green sheets (which turn to glass-ceramic layers 20A and 20B after being sintered) are laminated. On the top of the uppermost glass-ceramic green sheet (which turns to glass-ceramic layer 20B after being sintered), conductor layers which turn to five inductor conductors 19 are formed by using the aforementioned conductive paste mainly composed of silver by screen printing. Furthermore, several glass-ceramic green sheets (which turn to glass-ceramic ceramic layer 20C after being sintered) are laminated on the conductor layers. This laminate is heated in the atmosphere for removing the binder, and then sintered by being heated to 900° C. in the atmosphere to form low temperature co-fired ceramic substrate 20 containing the five inductors. Low temperature co-fired ceramic substrate 20 has a thickness of about 250 μm.

Next, zinc oxide green sheets are produced using ceramic powder having zinc oxide (ZnO) as a main component and also using an organic binder. At this moment, each of the zinc oxide green sheets has a thickness of about 30 μm.

A conductor layer, which turns to ground inner electrode 14D, is formed onto a zinc oxide green sheet (which turns to varistor layer 10F after being sintered) by using the conductive paste mainly composed of silver by screen printing. Then, another zinc oxide green sheet (which turns to varistor layer 10G after being sintered) is laminated on the conductor layer. Furthermore, conductor layers, which turn to be ground outer electrode 15E, input outer electrodes 15F and output outer electrodes 15G, are formed on the zinc oxide green sheet by using the silver paste by screen printing. This is the completion of a laminate which turns to varistor region 40.

Next, the laminate is pasted on low temperature co-fired ceramic substrate 20 so as to form a laminate block. Each of the conductor layers is about 2.5 μm thick. The laminate block consists of a plurality of units each having the shape shown in FIGS. 7 and 8 so that the printed conductor layers can be arranged on the green sheets in the pattern shown in FIGS. 7 and 8 after the laminate block is cut.

The laminate block is heated in the atmosphere for removing the binder. Then, the laminate block is sintered by being heated to 930° C. in the atmosphere to form an integrally sintered body. Later, the sintered body can be cut in desired dimensions, thereby obtaining a ceramic sintered body which has not yet been provided with connection electrodes 16C and 16D of the protection component shown in FIGS. 7 and 8.

Next, the conductive paste mainly composed of silver is applied onto both ends of the short side of the ceramic sintered body to which ground inner electrode 14D has been exposed so that the exposed ends of ground inner electrode 14D can be electrically connected with ground outer electrode 15E. In the same manner, the conductive paste mainly composed of silver is applied onto one end of the long side of the ceramic sintered body to which inductor conductors 19 have been exposed at one end thereof so that the exposed ends of inductor conductors 19 can be electrically connected with the corresponding ones of input outer electrodes 15F. In addition, the conductive paste mainly composed of silver is applied onto the other end of the long side of the ceramic sintered body to which inductor conductors 19 have been exposed at the other end thereof so that the exposed ends of inductor conductors 19 can be electrically connected with the corresponding ones of output outer electrodes 15D. After these applications, sintering is performed at 800° C. to form connection electrodes 16C and 16D. Note that there are other connection electrodes, which are disposed in the position opposed to connection electrodes 16D but they are not illustrated. This is the completion of protection component of the present embodiment shown in FIGS. 7 and 8.

The protection component of the present embodiment measures about 6.0 mm in length, about 3.0 mm in width and about 0.3 mm in thickness. Each of the five independent varistors has a capacitance of 6 to 8 pF between input outer electrodes 15F and ground outer electrode 15E, and a varistor voltage $V_{1mA}$ of 25 to 30V. Each of the five inductors has an inductance of about 100 nH between input outer electrodes 15F and output outer electrodes 15G.

The protection component of the present embodiment is evaluated for its effect of reducing electrostatic discharge pulse voltage. The evaluation is performed in the same manner as in the electrostatic discharge test described in the first embodiment. In other words, the protection component of the present embodiment is used as evaluation sample 109 shown in FIG. 4. Input outer electrodes 205 are connected to the input side of signal line 108, that is, the resistor 106 side, whereas output outer electrodes 206 are connected to the output side of signal line 108, that is, the protected appliance 110 side. Furthermore, ground outer electrode 203 is connected with ground line 107. After these connections, the protection component is evaluated for the effect of reducing electrostatic discharge pulse voltage by applying an electrostatic discharge pulse with a voltage of 8 kV from the circuit shown in FIG. 4 and by measuring the peak voltage value of the electrostatic discharge pulse applied on protected appliance 110. The evaluation is given to each of the five varistors, and the inductors connected to these varistors.

Input outer electrodes 205 correspond to input outer electrodes 15F; output outer electrodes 206 correspond to output outer electrodes 15G; and ground outer electrode 203 corresponds to ground outer electrode 15E shown in FIGS. 7 and 8.

When the protection component of the present embodiment is provided, the peak voltages applied on protected appliance 110 are about 150 to 200V at the respective terminals. This reveals that the protection component of the present embodiment has the effect of absorbing and reducing electrostatic discharge pulses sufficiently.

In the protection component of the present embodiment, controlling the inductance of inductors 204 and the capacitance of varistors 201 can form a two-stage low pass filter. This low pass filter can provide a more excellent noise reduction effect.

In the protection component of the present embodiment, the inductors and the varistors can have a multistage structure such as T-type or p-type. In these cases, adjusting the inductance and capacitance to appropriate values can facilitate the formation of a three-, four- or more-stage low pass filter. This can further improve the function as a low pass filter.

In the first to third embodiments, the array structures are formed of ten varistors, or five varistors and five inductors; however, the present invention is not limited to these structures. Provided that the dimensions and performance requirements of the protection component are met, the array may be formed of other numbers of varistors. Although the protection component of the present invention is characterized by its thinness, the aforementioned embodiments are not the only possible examples in term of the thickness of the entire component, of the varistor layers, and of the ceramic insulating substrate.

The number of effective layers to obtain varistor function in the plurality of varistors is either one or two in the first to third embodiments; however, the number is not particularly limited. Furthermore, as the ceramic insulating substrate, an alumina substrate and a low temperature co-fired ceramic substrate are used in the first to third embodiments; however, these are not the only possible examples. Instead of them, it is also possible to use ferrite or a dielectric with high dielectric constant.

Although the silver paste is used as the conductive paste in the above examples, this is not the only possible example. Instead of the silver paste, it is also possible to use a conductive paste containing silver-palladium, platinum or another metal. The inner electrodes may be formed on the interface between the varistor region and the ceramic insulating substrate.

In the protection components of the first and third embodiments, it is possible to provide a protective film and to apply plating. This structure enables the protection components to have the same excellent mountability as that of the second embodiment. The formation of the protective film and the application of plating can be done either before or after the sintered body is cut in desired dimensions.

What is claimed is:

1. An electrostatic discharge protection component of an array type having a plurality of varistors, comprising:

a ceramic insulating substrate;

a varistor region which is pasted on the ceramic insulating substrate and then is sintered integrally with the ceramic insulating substrate; and a ground outer electrode and a plurality of input/output outer electrodes, wherein the varistor region includes a ground inner electrode, a varistor layer and the plurality of input/output outer electrodes so as to form the plurality of varistors, and the ground inner electrode is connected with the ground outer electrode.

2. The electrostatic discharge protection component of claim 1, wherein the varistor region further includes a plurality of inner electrodes in a position to oppose the ground inner electrode via the varistor layer, and the plurality of inner electrodes are connected with corresponding ones of the plurality of input/output outer electrodes.

3. The electrostatic discharge protection component of claim 1, wherein the ground outer electrode and the plurality of input/output outer electrodes are formed on a same surface of the varistor region.

4. The electrostatic discharge protection component of claim 1, wherein the ceramic insulating substrate is at least twice as thick as the varistor region.

5. The electrostatic discharge protection component of claim 1, wherein the varistor layer is made of a varistor material mainly composed of zinc oxide, and the ceramic insulating substrate is an alumina substrate with a copper oxide content of not more than 0.1% by weight.

6. The electrostatic discharge protection component of claim 1, wherein the varistor region is provided, on a top surface thereof, with a protective film except for a region where the ground outer electrode and the plurality of input/output outer electrodes are formed.

7. The electrostatic discharge protection component of claim 1, wherein as the ceramic insulating substrate, a substrate including a plurality of inductors is used, and the plurality of inductors are electrically connected in series with corresponding ones of the plurality of varistors.

* * * * *